US008449060B2

(12) United States Patent
Kitahara

(10) Patent No.: US 8,449,060 B2
(45) Date of Patent: May 28, 2013

(54) LIQUID EJECTING APPARATUS AND FLYING CURVE DETECTING METHOD

(75) Inventor: Yukari Kitahara, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 417 days.

(21) Appl. No.: 12/723,836

(22) Filed: Mar. 15, 2010

(65) Prior Publication Data

US 2010/0245428 A1 Sep. 30, 2010

(30) Foreign Application Priority Data

Mar. 26, 2009 (JP) ..... 2009-077839

(51) Int. Cl.
*B41J 29/38* (2006.01)
*B41J 2/205* (2006.01)
*B41J 29/393* (2006.01)

(52) U.S. Cl.
USPC ..... 347/12; 347/15; 347/19

(58) Field of Classification Search
None
See application file for complete search history.

(56) References Cited

U.S. PATENT DOCUMENTS

| | | | | |
|---|---|---|---|---|
| 6,714,748 | B1 * | 3/2004 | Nakayasu et al. | 399/72 |
| 7,272,332 | B2 * | 9/2007 | Kitagawa et al. | 399/49 |
| 7,429,094 | B2 * | 9/2008 | Hamasaki et al. | 347/41 |
| 2003/0085940 | A1 * | 5/2003 | Yamada | 347/19 |
| 2003/0142158 | A1 * | 7/2003 | Lee | 347/12 |
| 2005/0052494 | A1 * | 3/2005 | Takahashi et al. | 347/41 |
| 2006/0114284 | A1 * | 6/2006 | Mizes et al. | 347/19 |
| 2006/0119633 | A1 * | 6/2006 | Hsu et al. | 347/19 |
| 2006/0132519 | A1 * | 6/2006 | Kovacs | 347/12 |
| 2007/0120885 | A1 * | 5/2007 | Jeong | 347/19 |
| 2008/0211850 | A1 * | 9/2008 | Miyamoto et al. | 347/15 |
| 2008/0211854 | A1 * | 9/2008 | Takahashi et al. | 347/19 |
| 2009/0085952 | A1 * | 4/2009 | Yamazaki | 347/19 |

FOREIGN PATENT DOCUMENTS

| | | | |
|---|---|---|---|
| EP | 1213153 | A1 * | 6/2002 |
| EP | 1935653 | A1 * | 6/2008 |
| JP | 2004015421 | A * | 1/2004 |
| JP | 2004195703 | A * | 7/2004 |
| JP | 2005-246650 | | 9/2005 |
| JP | 2007-021968 | | 2/2007 |

* cited by examiner

*Primary Examiner* — Stephen Meier
*Assistant Examiner* — Leonard S Liang
(74) *Attorney, Agent, or Firm* — Workman Nydegger

(57) ABSTRACT

A liquid ejecting apparatus includes a liquid ejecting head having a nozzle row including nozzles that eject a liquid on an ejecting target medium. The liquid ejecting head moves with respect to the ejecting target medium in a main scanning direction. Liquid is ejected to form test patterns on the ejecting target medium, in which the minimum interval between a plurality of dots formed by ejecting the liquid in the main scanning direction is set as a reference interval. A dot group is formed, in which one or more dots line up at the reference interval in the main scanning direction. A line part is formed, in which a plurality of the dot groups is formed at an interval larger than the reference interval in the main scanning direction. A plurality of the line parts is formed in a sub-scanning direction intersecting the main scanning direction.

2 Claims, 11 Drawing Sheets

LIQUID EJECTING APPARATUS AND FLYING CURVE DETECTING METHOD

CROSS-REFERENCE TO RELATED APPLICATIONS

This application claims the benefit of priority to Japanese Patent Application No. 2009-077839 filed Mar. 26, 2009, the contents of which are hereby incorporated by reference in their entirety.

BACKGROUND

1. Technical Field

The present invention relates to a liquid ejecting apparatus and a flying curve detecting method, and more particularly, to an ink jet printing apparatus and a method of detecting a flying curve of dots ejected by the ink jet printing apparatus capable of ejecting ink as a liquid.

2. Related Art

As a liquid ejecting apparatus ejecting a liquid on an ejecting target medium, there is known an ink jet printing apparatus capable of performing printing on a printing medium (ejecting target medium) such as a paper sheet or a print sheet by ejecting ink as a liquid. An ink jet printing head has a nozzle row in which nozzles ejecting ink are arranged and is disposed in the ink jet printing apparatus so that an arrangement direction of the nozzles intersects a main scanning direction.

The ink jet printing apparatus performs one-pass printing by moving the ink jet printing head in the main scanning direction with respect to the printing medium. In the one-pass printing, the ink jet printing head moves in the main scanning direction while ejecting the ink so as to eject the ink continuously from the nozzles arranged in the arrangement direction in the main scanning direction. In addition, by moving the printing medium in a sub-scanning direction intersecting the main scanning direction, the printing is realized on the entire surface of the printing medium.

In such an ink jet printing apparatus, a problem may arise in that ink droplets ejected from the nozzles curvedly fly due to the ink saturated in the vicinities of the nozzles and thus the ink droplets are landed to a position deviated from the original landing position of the printing medium. In order to detect such a flying curve, there was suggested an apparatus capable of detecting the flying curve on the basis of whether a predetermined test pattern is formed with a predetermined shape by forming the test pattern on the printing medium (for example, see JP-A-2007-21968).

Specifically, the ink jet printing apparatus prints a so-called solid test pattern on a printing medium by continuously ejecting ink in the main scanning direction from the respective nozzles. At this time, when a flying curve occurs in one nozzle, dots formed by the corresponding nozzle may be formed at positions deviated from the original landing positions and thus some dots become void in a ground portion (the surface of the printing medium). By viewing the ground portion, it is possible to detect the flying curve.

However, since the ink droplets are ejected with a high density, a problem may arise in that it is difficult to view the deviated ink droplets easily even in a case where the ink droplets curvedly fly and land at the deviated positions.

Alternatively, the flying curve can be detected by reading the test pattern by an optical unit, for example, to determine whether the test pattern is formed with a predetermined shape. However, a problem with cost may arise in that an optical unit, a member, or an apparatus has to be further provided to detect the flying curve.

Moreover, such a problem may occur not only in the ink jet printing head but a liquid ejecting apparatus ejecting a liquid other than ink.

SUMMARY

An advantage of some aspects of the invention is that it provides a liquid ejecting apparatus and a flying curve detecting method capable of improving a detection precision of dot missing in a flying curve.

According to an aspect of the invention, there is provided a liquid ejecting apparatus including: a liquid ejecting head which has a nozzle row in which a plurality of nozzles ejecting a liquid on an ejecting target medium is arranged; a moving unit which relatively moves the liquid ejecting head with respect to the ejecting target medium in a main scanning direction intersecting an arrangement direction of the nozzles; and a control unit which permits the liquid ejecting head to eject the liquid so as to form a plurality of test patterns on the ejecting target medium, the test pattern being formed such that the minimum interval between a plurality of dots formed by ejecting the liquid in the main scanning direction by the liquid ejecting head is set as a reference interval, a dot group where one or more dots formed by the nozzles of the nozzle group formed by the plurality of nozzles line up at the reference interval in the main scanning direction is formed, a line part where a plurality of the dot groups is formed at an interval larger than the reference interval in the main scanning direction is formed, and a plurality of the line parts is formed in a sub-scanning direction intersecting the main scanning direction. The control unit forms the dot groups so that widths of the dot groups in the main scanning direction are equal to each other and forms the test pattern so that intervals of the dot groups forming each line part in the main scanning direction are equal to each other.

With such a configuration, the liquid is ejected on the ejecting target medium to form the uniform test pattern. When a flying curve occurs in the liquid ejecting head, a difference in shading appears in the uniform test pattern. Since such a difference in shading can be easily recognized, it is possible to detect that the flying curve occurs in the liquid ejecting head by use of the difference in shading.

In the liquid ejecting apparatus, the control unit may permit a first nozzle group, where nozzle sets formed by adjacent N (where N is a natural number) nozzles in the nozzle group line up at an interval of N nozzles, and a second nozzle group, where the other nozzles line up, to form the dot group alternately in the main scanning direction. With such a configuration, it is possible to form the check test pattern. Moreover, it is possible to easily detect deviation of the landed position of the liquid.

In the liquid ejecting apparatus, the control unit may form the test pattern so that the line parts lining up in the sub-scanning direction are located at the same position in the main scanning direction. With such a configuration, the test pattern is formed such that a plurality of vertical lines extending in the sub-scanning direction is formed in the main scanning direction. In particular, it is possible to easily detect the deviation of the landed position of the liquid in the sub-scanning direction.

According to another aspect of the invention, there is provided a method of detecting a flying curve of dots formed by a liquid ejecting apparatus including a liquid ejecting head which has a nozzle row in which a plurality of nozzles ejecting a liquid on an ejecting target medium is arranged and a moving unit which relatively moves the liquid ejecting head with respect to the ejecting target medium in a main scanning direction intersecting an arrangement direction of the nozzles. The method includes: ejecting a liquid by the liquid ejecting head to form a test pattern on the ejecting target medium, the test pattern being formed such that the minimum interval between a plurality of dots formed by ejecting the liquid in the main scanning direction by the liquid ejecting head is set as a reference interval, a dot group where one or more dots formed by the nozzles of the nozzle group formed by the plurality of nozzles line up at the reference interval in the main scanning direction is formed, a line part where a plurality of the dot groups is formed at an interval larger than the reference interval in the main scanning direction is formed, and a plurality of the line parts is formed in a sub-scanning direction intersecting the main scanning direction; forming the dot groups so that widths of the dot groups in the main scanning direction are equal to each other and forming the test pattern so that intervals of the dot groups forming each line part in the main scanning direction are equal to each other.

With such a configuration, the liquid is ejected on the ejecting target medium to form the uniform test pattern. When a flying curve occurs in the liquid ejecting head, a difference in shading appears in the uniform test pattern. Since such a difference in shading can be easily recognized, it is possible to detect that the flying curve occurs in the liquid ejecting head by use of the difference in shading.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described.

Embodiment 1

Figure 1:
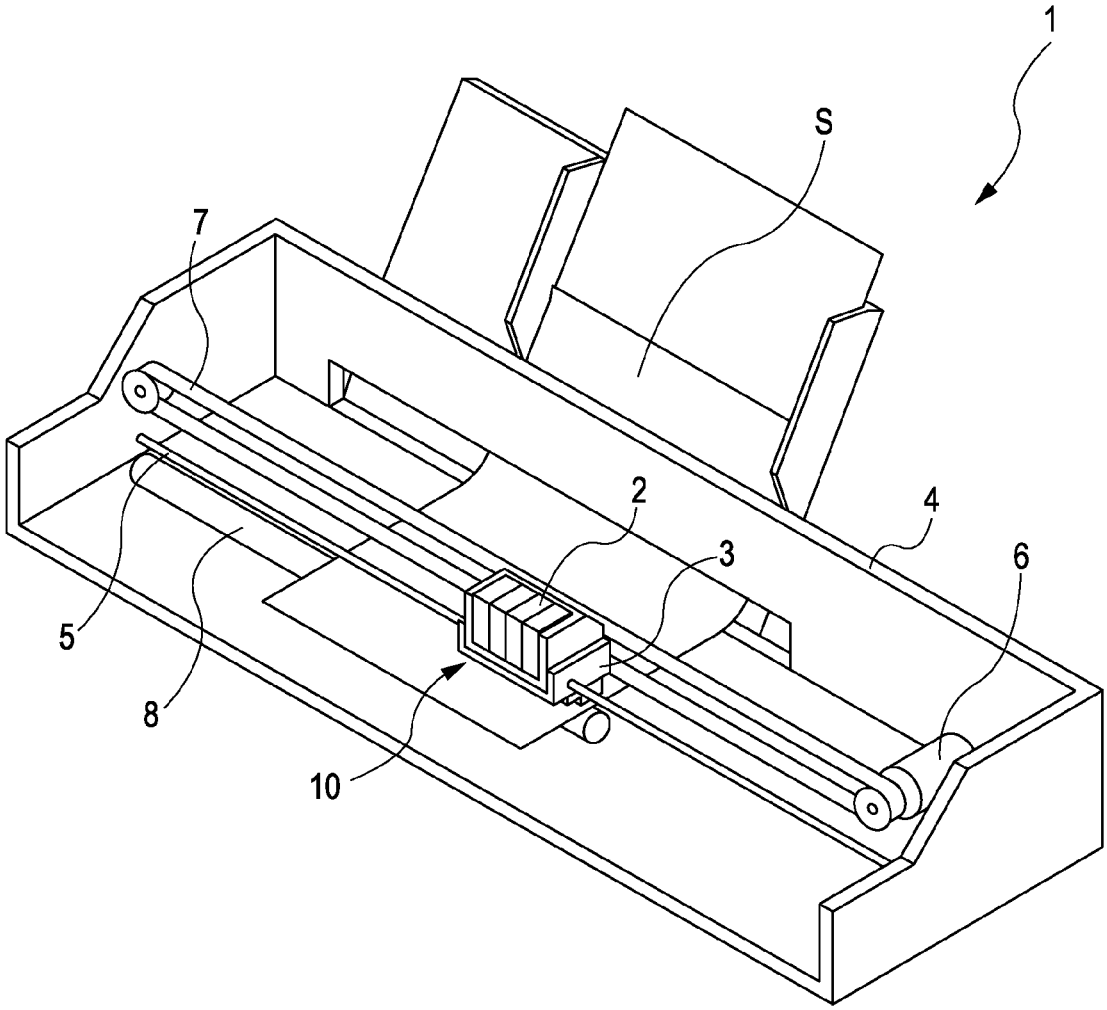
FIG. 1 is a schematic perspective view illustrating a printing apparatus according to Embodiment 1.

FIG. 1 is a schematic perspective view illustrating an ink jet printing apparatus, which is a liquid ejecting apparatus according to Embodiment 1 of the invention. In an ink jet printing apparatus 1 according to the invention, as shown in FIG. 1, an ink jet printing head (hereinafter, also referred to as a print head) 10, which is an example of a liquid ejecting head ejecting ink droplets, is fixed to a carriage 3 and an ink cartridge 2, which is a liquid storing member storing ink, is detachably mounted on the printing head 10.

The carriage 3 mounted with the printing head 10 is disposed in a carriage shaft 5 mounted in an apparatus main body 4 so as to be movable in a shaft direction. When a driving force of a driving motor (moving unit) 6 is transferred to the carriage 3 through a plurality of saw-toothed wheels (not shown) and a timing belt 7, the carriage 3 moves along the carriage shaft 5 in a main scanning direction. In the apparatus main body 4, a platen 8 and a sheet feeding unit (not shown) including a feeding roller and a sheet feeding motor rotating the feeding roller are disposed along the carriage shaft 5. A print sheet S, which is an ejecting target medium such as a paper sheet fed by the sheet feeding unit, is wound around the platen 8 in a sub-scanning direction to be fed. A controller (not shown), which is an example of a control unit, is disposed in the apparatus main body 4. The controller is configured to transmit a signal to the driving motor 6 or the sheet feeding motor of the sheet feeing unit to control the initiation and the interruption of the driving.

Such an ink jet printing apparatus 1 performs printing on the print sheet S in the main scanning direction by ejecting ink droplets from the printing head 10, while the controller moves the carriage 3 in the main scanning direction. The controller performs positioning in the sub-scanning direction by controlling the sheet feeding unit to transport the print sheet S in the sub-scanning direction. In this way, the printing can be performed on the print surface of the print sheet S.

Figure 2:
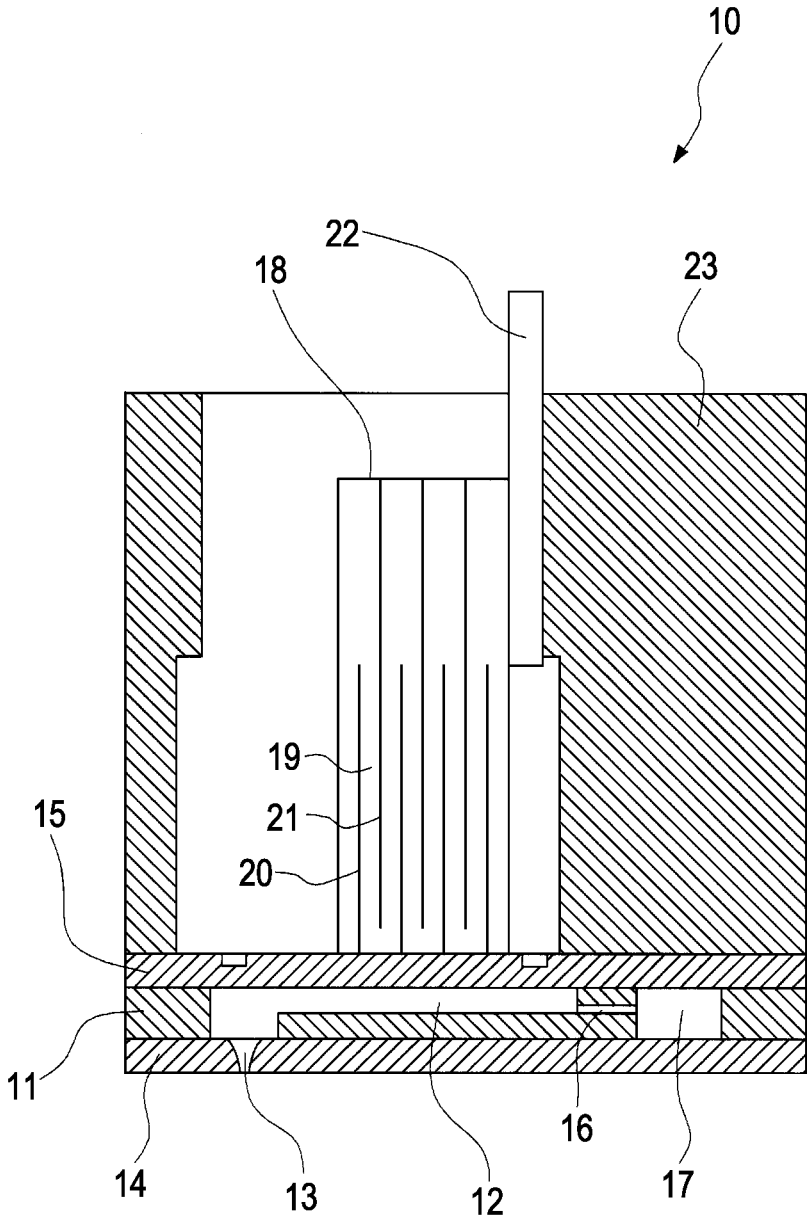
FIG. 2 is a sectional view illustrating a printing head according to Embodiment 1.

The ink jet printing head 10 mounted in the above-described ink jet printing apparatus 1 will be described. FIG. 2 is a sectional view illustrating an example of the ink jet printing head according to Embodiment 1 of the invention.

The ink jet printing head 10 shown in FIG. 2 has vertical vibration type piezoelectric elements. A plurality of pressurizing chambers 12 is arranged in parallel in a spacer 11. Both the sides of the spacer 11 are sealed by a nozzle plate 14 having nozzle openings (nozzles) 13 and a vibration plate 15 to correspond to the pressurizing chambers 12, respectively. The spacer 11 has a reservoir 17 which serves—as—a common ink chamber of the plurality of pressurizing chambers 12 and communicates with the pressurizing chambers 12 via ink supply ports 16, respectively. An ink cartridge (not shown) is connected to the reservoir 17.

On the other hand, on a side of the vibration plate 15 opposite to the pressurizing chambers 12, the front ends of the piezoelectric elements 18 come into contact with the areas corresponding to the pressurizing chambers 12. Such a piezoelectric element 18 is formed such that a piezoelectric material 19 is interposed between electrode forming materials 20 and 21 in a sandwich shape to form a laminated structure and an inactive area contributing to lack of vibration is fixed to a fixing board 22. The fixing board 22 is incorporated with the vibration plate 15, the spacer 11, and the nozzle plate 14 via a base support 23.

In the ink jet printing head 10 having such a configuration, the ink is supplied to the reservoir 17 via an ink passage communicating with the ink cartridge and is distributed to the pressurizing chambers 12 via the ink supply ports 16. In effect, the piezoelectric elements 18 are contracted by applying a voltage to the piezoelectric elements 18. In this way, the vibration plate 15 is deformed along with the piezoelectric elements 18 (raised in the upper direction in the drawing) to increase the volume of the pressurizing chambers 12, and thus to draw the ink in the pressurizing chambers 12. Then, the pressurizing chambers 12 are filled with ink until the ink reaches the nozzle openings 13. Subsequently, when the voltage applied to the electrode forming materials 20 and 21 of the piezoelectric elements 18 is released according to a record signal from a printing head driving circuit 102, which is described below, the expanded piezoelectric elements 18 are returned to the original state. In this way, since the vibration plate 15 is deformed to be returned to the original state, the pressurizing chambers 12 are contracted, the inside pressure increases, and thus the ink droplets are ejected from the nozzle openings 13. That is, in this embodiment, the vertical vibration type piezoelectric elements 18 serve as pressurizing units applying pressure variation to the pressurizing chambers 12.

The plurality of nozzle openings 13 is formed in the nozzle plate 14 to correspond to the pressurizing chambers 12 and a nozzle row in which the plurality of nozzle openings 13 is arranged is formed. The ink jet printing head 10 is disposed in the carriage 3 so that an arrangement direction of the nozzle openings 13 intersects the main scanning direction.

Figure 3:
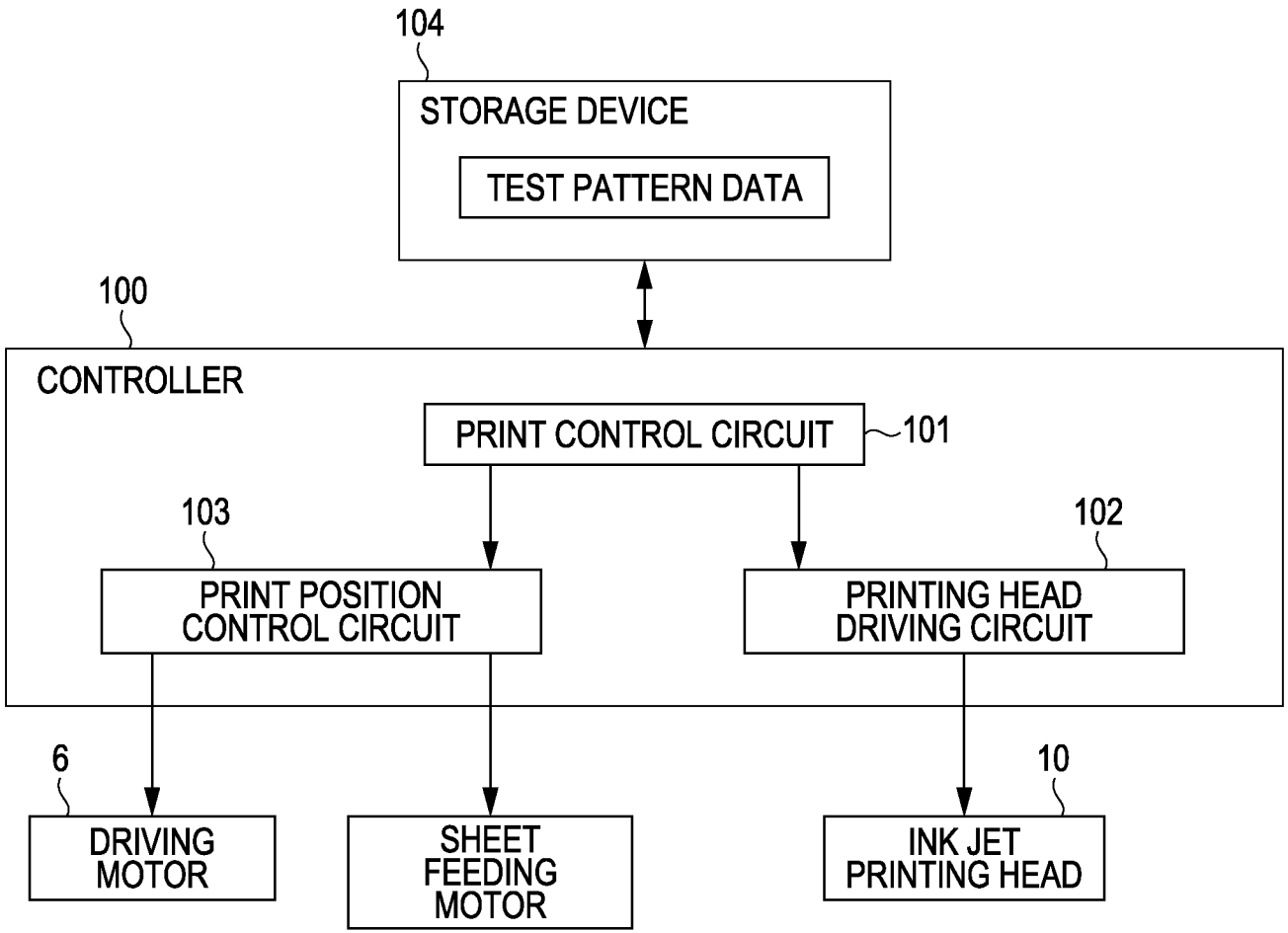
FIG. 3 is a block diagram illustrating a controller according to Embodiment 1.

A control system of the ink jet printing apparatus 1 will be described. FIG. 3 is a block diagram illustrating the control configuration of the ink jet printing apparatus.

As shown in FIG. 3, a controller (control unit) 100 of the ink jet printing apparatus includes a print control circuit 101, the printing head driving circuit 102, and a print position control circuit 103.

The print control circuit 101 controls the printing of the ink jet printing head 10. That is, the print control circuit 101 permits the print position control circuit 103 to control the position of the print head in the main scanning direction and the sub-scanning direction and permits the printing head driving circuit 102 to eject the ink from the print head.

Specifically, the print control circuit 101 permits the printing head driving circuit 102 to apply a driving pulse to the piezoelectric elements 18, which serve as the pressurizing unit disposed in the ink jet printing head 10, on the basis of the print signal input from the outside to eject the ink droplets from the nozzle openings 13 of the ink jet printing head 10.

The print position control circuit 103 performs the positioning of the ink jet printing head 10 in the main scanning direction and the sub-scanning direction at print time. Specifically, the print control circuit 101 permits the print position control circuit 103 to position the ink jet printing head 10 in the main scanning direction by driving the driving motor 6 and moving the carriage 3 in the main scanning direction and to position the ink jet printing head 10 in the sub-scanning direction with respect to the print sheet S by driving the sheet feeding motor and moving the print sheet S in the sub-scanning direction.

In this way, the print control circuit 101 forms an image by ejecting the ink from the nozzle openings 13 by the ink jet printing head 10, while moving the carriage 3 mounted with the ink jet printing head 10 in the main scanning direction on the basis of the print signal, and prints the image on the entire print sheet S by moving the print sheet S in the sub-scanning direction.

The ink jet printing apparatus 1 further includes a storage device 104 such as a ROM or a flash memory storing test pattern data. The controller 100 reads the test pattern data from the storage device 104 to print a test pattern on the print sheet S on the basis of the test pattern data. The test pattern data refers to a signal indicating information regarding the ejection of the ink from the ink jet printing head 10 so as to form a test pattern of a predetermined shape at a predetermined position of the print sheet S.

Figure 4:
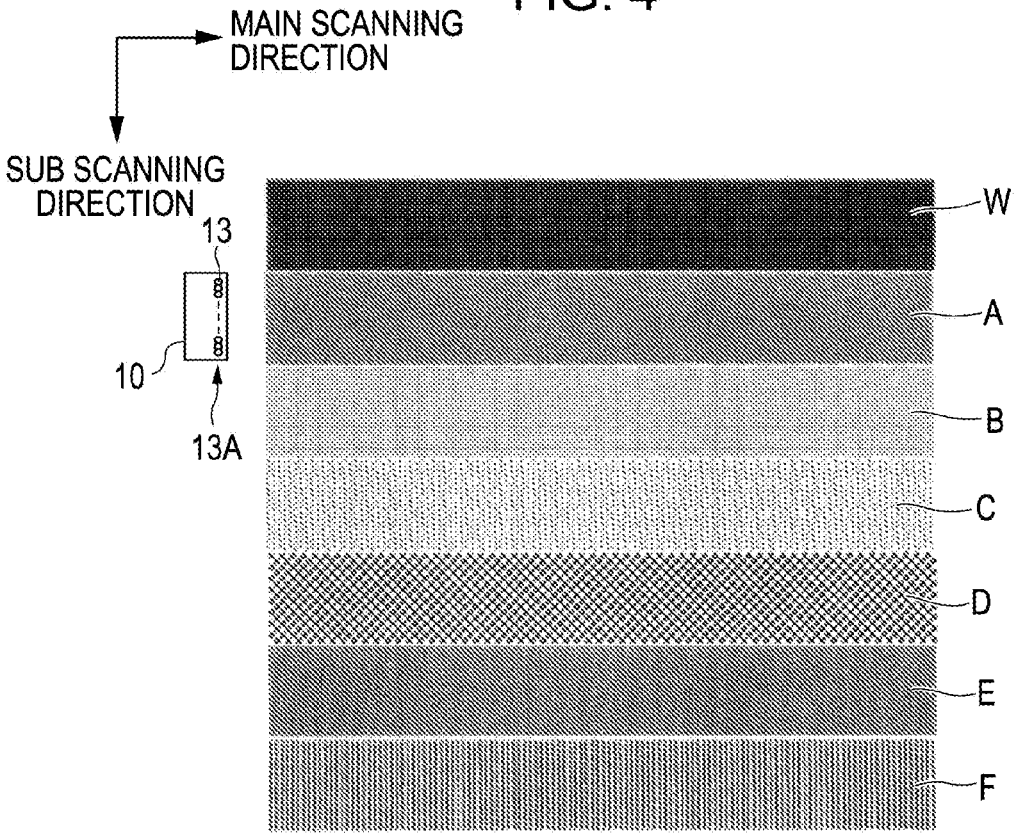
FIG. 4 is a top view illustrating a test pattern with no flying curve according to Embodiment 1.

Hereinafter, the test pattern formed on the print sheet S will be described. FIG. 4 is a top view illustrating a plurality of test patterns. As illustrated, test patterns A to F are used as the test pattern according to this embodiment. Test pattern W is formed in a so-called solid shape and is used to make the comparison.

As illustrated, each of test patterns A to D is a check test pattern and each of test patterns E and F is a test pattern with a plurality of lines extending in a vertical direction (sub-scanning direction). All of the test patterns are formed when no flying curve occurs in the printing head 10.

Figure 5:
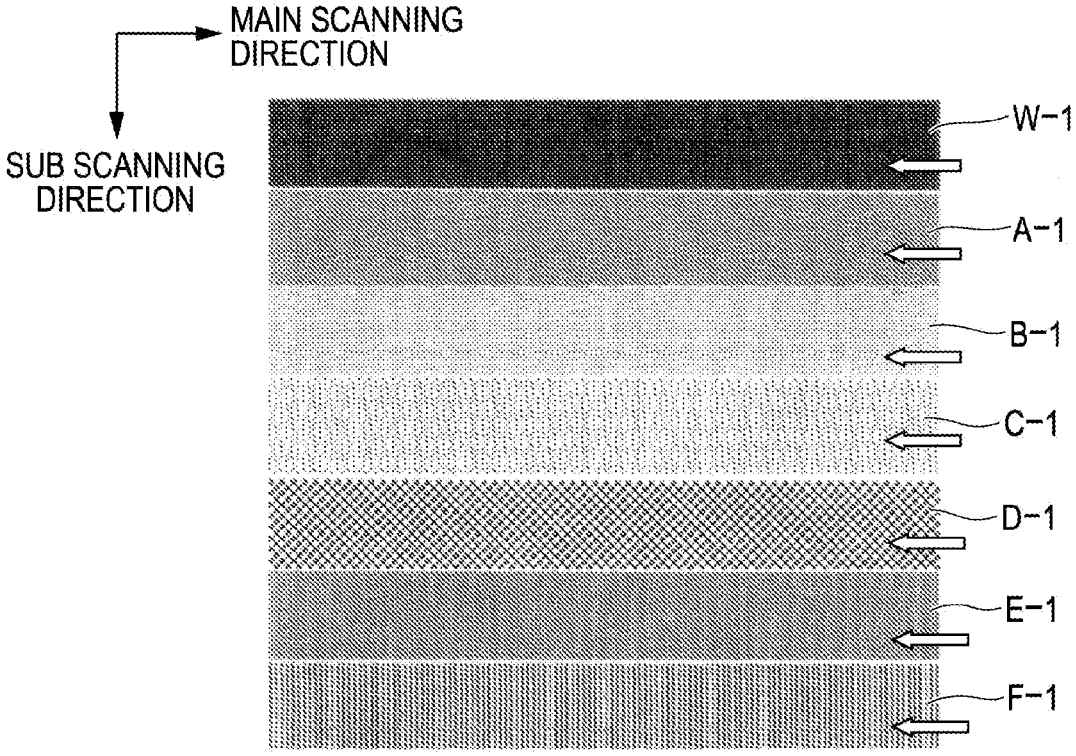
FIG. 5 is a top view illustrating a test pattern with a flying curve according to Embodiment 1.

FIG. 5 is a top view illustrating a plurality of test patterns formed when the flying curve occurs. As shown in FIG. 5, test patterns A-1 to F-1 formed when the flying curve occurs are illustrated to correspond to test patterns A to F shown in FIG. 4. Such test patterns A-1 to F-1 are formed when the ink ejected from the specific nozzle opening 13 is landed at a position deviated from the original position at which the ink has to be landed. For this reason, test patterns A to F shown in FIG. 4 have a uniform shape, whereas test patterns A-1 to F-1 have line parts with different shading in a horizontal direction at the positions indicated by the arrows in FIG. 4. In test pattern W, only the flying curve in the sub-scanning direction can be recognized.

Hereinafter, such test patterns A to F will be described in detail.

Test Pattern A

Figure 6A:
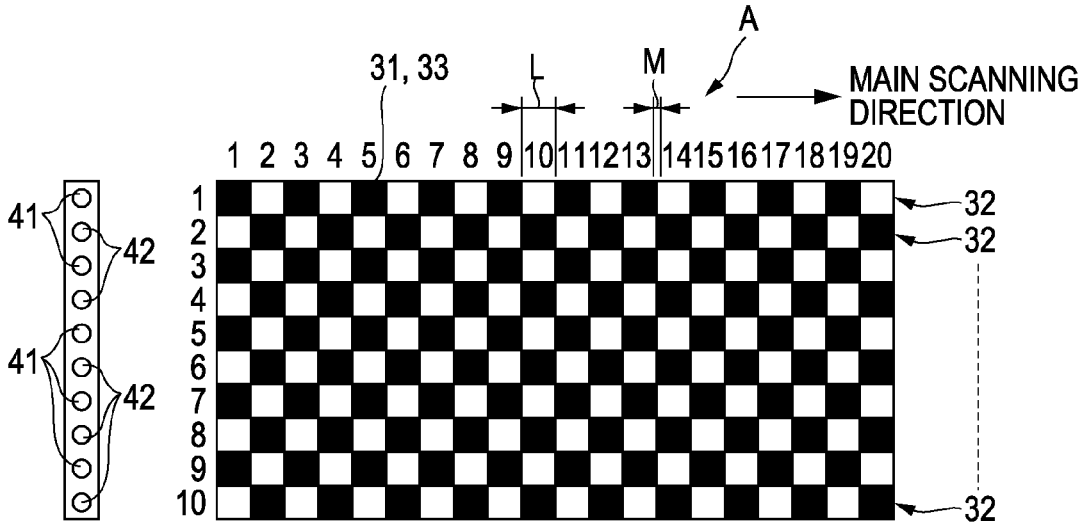
FIGS. 6A and 6B are top views illustrating examples of the test pattern according to Embodiment 1.
Figure 6B:
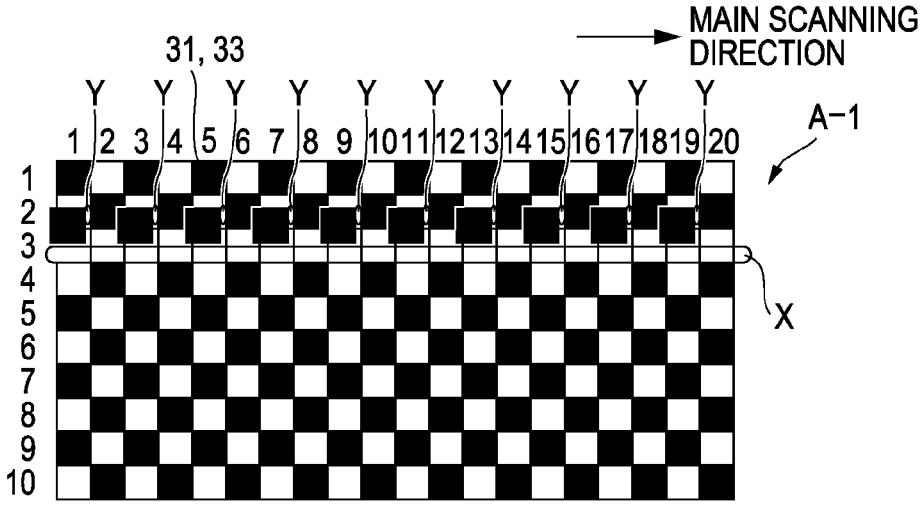

FIG. 6A is an enlarged top view illustrating an example of a test pattern according to this embodiment. FIG. 6B is an enlarged top view illustrating a test pattern when a flying curve occurs.

As shown in FIG. 6A, test pattern A is formed such that a dot group 31 where one or more dots 33 formed by the nozzle openings 13 of a nozzle group 13A line up at a reference interval M in the main scanning direction is formed, a line part 32 where a plurality of the dot groups 31 lines up at an interval L larger than the reference interval M in the main scanning direction is formed, and a plurality of the line parts 32 is formed in the sub-scanning direction. The respective dot groups 31 of the line parts 32 adjacent to each other in the sub-scanning direction line up at different positions in the main scanning direction.

The nozzle group 13A is formed from one or more nozzle openings 13 ejecting ink to form test pattern A. In this embodiment, the plurality of nozzle openings 13 lines up in the nozzle plate of the printing head 10 to form the nozzle row. This nozzle row serves as the nozzle group 13A. That is, test pattern A is formed by ejecting the ink from all of the nozzle openings 13 forming the nozzle row.

The reference interval M refers to the minimum interval between the plurality of dots 33 formed by ejecting the ink in the main scanning direction by the printing head 10. That is, the reference interval M refers to the minimum interval between the dots 33 which can be formed by the printing head 10. In this embodiment, since the printing head 10 continuously ejects the ink in the main scanning direction with the width of one dot 33, the reference interval M is zero in effect.

The dot group 31 refers to a group where one or more dots 33 formed by the nozzle openings 13 of the nozzle group 13A line up at the reference interval M in the main scanning direction. Here, "the group where one or more dots 33 line up at the reference interval M in the main scanning direction" includes one dot group 31 formed by one dot 33. In test pattern A, one dot group 31 is formed by one dot 33.

The width of each dot group 31 in the main scanning direction is the width of one dot 33. The intervals L between the dot groups 31 forming each line part 32 are equal (the width corresponding to one dot 33) to each other.

The controller 100 forms test pattern A described above under the assumption that no flying curve occurs. When the actually formed test pattern is different from test pattern A, it can be determined that a flying curve occurs.

Hereinafter, a method of controlling test pattern A will be described in detail.

The controller 100 permits a first nozzle group, where nozzle sets formed by adjacent N (where N is a natural number) nozzle openings 13 among the nozzle openings 13 forming the nozzle group 13A line up at an interval of N nozzle openings, and a second nozzle group, where the other nozzle openings 13 line up, to form the dot groups alternately in the main scanning direction.

In this embodiment, check test pattern A is formed by forming the dot groups 31 at an interval of one dot. Therefore, in a first nozzle group 41, the nozzle sets (that is, one nozzle opening 13) formed by adjacent one nozzle opening 13 line up at an interval of one nozzle opening. In a second nozzle group 42, the other nozzle openings 13 line up. That is, the first nozzle group 41 and the second nozzle group 42 are formed by every other nozzle opening 13 forming the nozzle group 13A, respectively.

Specifically, the controller 100 permits the first nozzle group 41 to eject the ink to a first column from the left side of test pattern A. In this way, the dot groups 31 are formed in the first, third, fifth, seventh, and ninth rows of the first column of test pattern A. Subsequently, the controller 100 permits the second nozzle group 42 to eject the ink in a second column from the left side of test pattern A. In this way, the dot groups 31 are formed in the second, fourth, sixth, eighth, and tenth rows of the second column of test pattern A. Subsequently, the first nozzle group 41 and the second nozzle group 42 alternately eject the ink up to a twentieth column from the left side of test pattern A.

In this way, in the case where no flying curve occurs, test pattern A of the appearance shape shown in FIG. 4 is formed when the controller 100 forms test pattern A.

FIG. 6B is the top view illustrating test pattern A-1. Test pattern A-1 is formed when a flying curve occurs in the nozzle opening 13 forming a third row of dot groups 31 from the upper side. In this embodiment, as illustrated, the third row of dot groups 31 is deviated in the main scanning direction and the sub-scanning direction (an upper left side in the drawing) from the original positions, at which the ink has to be landed, and thus overlaps with a second row of dot groups 31.

For this reason, a ground area X (the surface of the print sheet S) extending in the main scanning direction between the third and fourth rows appears. Moreover, ground areas Y appear in the main scanning direction between the second row of dot groups 31 and the third row of dot groups 31 to the degree that the third row of dot groups 31 overlaps with the second row of dot groups 31.

When the flying curve occurs in the nozzle openings 13 upon forming check test pattern A where the dot groups 31 line up at the interval of one dot, test pattern A-1 containing the ground area X and the ground areas Y may be formed. When the whole of test pattern A-1 is viewed, the ground area X and the ground areas Y appear as a difference in shading of a horizontally extended line shape in the uniform check test pattern A-1 (see FIG. 5). Since such a difference in shading can easily be recognized, it is possible to reliably detect the flying curve occurring in the nozzle openings 13 forming the nozzle group 13A.

Test Pattern B

In forming test pattern A, the interval of the dots between the dot groups 31 forming each line part 32 is the interval of one dot 33, but the invention is not limited thereto. For example, test pattern B formed when the interval L of the dot groups 31 is an interval of three dots 33 will be descried.

Figure 7A:
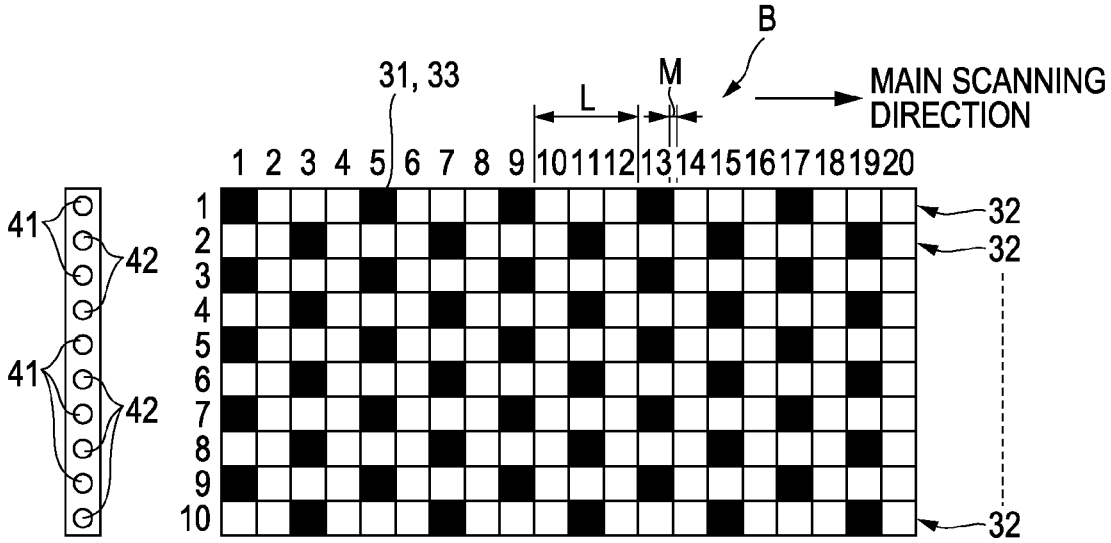
FIGS. 7A and 7B are top views illustrating examples of the test pattern according to Embodiment 1.
Figure 7B:
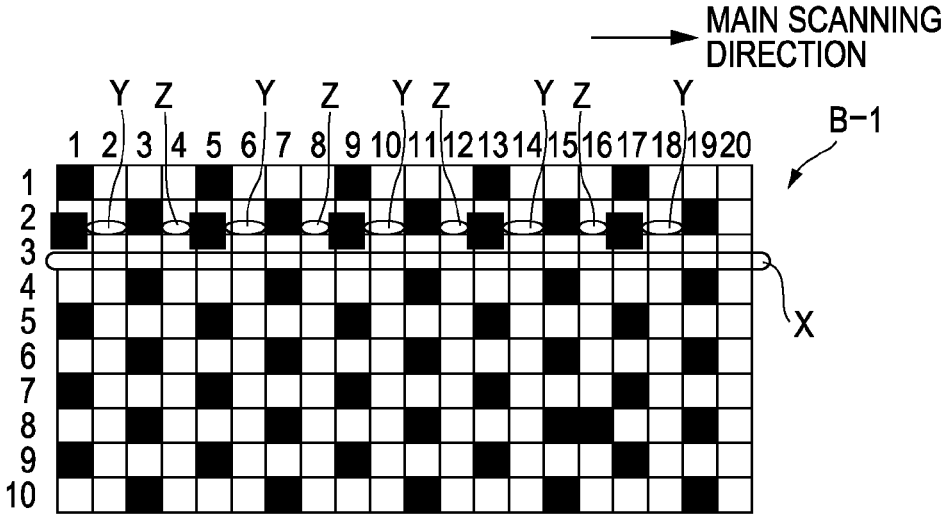

FIG. 7A is an enlarged top view illustrating an example of a test pattern according to this embodiment. FIG. 7B is an enlarged top view illustrating a test pattern when a flying curve occurs.

As shown in FIG. 7A, a different point between test pattern B and test pattern A is that the interval L of the dot groups 31 forming each line part 32 is larger in test pattern B. That is, the interval L in test pattern B is an interval of three dots 33.

Hereinafter, a method of controlling test pattern B will be described in detail.

The controller 100 permits a first nozzle group, where nozzle sets formed by adjacent N (where N is a natural number) nozzle openings 13 among the nozzle openings 13 forming the nozzle group 13A line up at an interval of N nozzle openings, and a second nozzle group, where the other nozzle openings 13 line up, to form the dot groups alternately in the main scanning direction.

In this embodiment, check test pattern B is formed by forming the dot groups 31 at the interval of three dots. Therefore, in the first nozzle group 41, the nozzle sets (that is, one nozzle opening 13) formed by adjacent one nozzle opening 13 line up at an interval of one nozzle opening. In a second nozzle group 42, the other nozzle openings 13 line up. That is, the first nozzle group 41 and the second nozzle group 42 are formed by every other nozzle opening 13 forming the nozzle group 13A, respectively.

Specifically, the controller 100 permits the first nozzle group 41 to eject the ink to a first column from the left side of test pattern B. In this way, the dot groups 31 are formed in the first, third, fifth, seventh, and ninth rows of the first column of test pattern B. Subsequently, the controller 100 permits the second nozzle group 42 to eject the ink to a third column from the left side of test pattern B. In this way, the dot groups 31 are formed in the second, fourth, sixth, eighth, and tenth rows of the third column of test pattern B.

Subsequently, the first nozzle group 41 ejects the ink in a fifth column from the left side of test pattern B, that is, at the interval L (a width corresponding to three dots 33) from the first column of dot previously formed by the first nozzle group 41. In this way, the dot groups 31 are formed in the first, third, fifth, seventh, and ninth rows of the fifth column of test pattern B. Subsequently, the second nozzle group 42 ejects the ink in a seventh column from the left side of test pattern B, that is, at the interval L from the third column of dot previously formed by the second nozzle group 42. In this way, the dot groups 31 are formed in the second, fourth, sixth, eighth, and tenth rows of the seventh column of test pattern B. Subsequently, the first nozzle group 41 and the second nozzle group 42 alternately eject the ink up to a twentieth column from the left side of test pattern B.

FIG. 7B is the top view illustrating test pattern B-1. Test pattern B-1 is formed when a flying curve occurs in the nozzle opening 13 forming a third row of dot groups 31 from the upper side. In this embodiment, as illustrated, the third row of dot groups 31 is deviated in the main scanning direction and the sub-scanning direction (an upper left side in the drawing) from the original positions, at which the ink has to be landed.

For this reason, the ground area X (the surface of the print sheet S) extending in the main scanning direction between the third and fourth rows appears. Moreover, the third row of dot groups 31 is deviated in the main scanning direction and the sub-scanning direction and the interval between the second row of dot groups 31 and the third row of dot groups 31 in the main scanning direction becomes dense. That is, since the third row of dot groups 31 is deviated in the main scanning direction, ground areas Y of which a width is relatively broader in the main scanning direction and ground areas Z of which a width is relatively narrower in the main scanning direction appear between the second row of dot groups 31 and the third row of dot groups 31.

When the flying curve occurs in the nozzle openings 13 upon forming test pattern B where the dot groups 31 line up at the interval of three dots, test pattern B-1 containing the ground area X, the ground areas Y, and the ground areas Z may be formed. When the whole of test pattern B-1 is viewed, the ground area X, the ground areas Y, and the ground areas Z appear as a difference in shading of a horizontally extended line shape in the uniform test pattern B-1 (see FIG. 5). Since such a difference in shading can easily be recognized, it is possible to reliably detect the flying curve occurring in the nozzle openings 13 forming the nozzle group 13A.

Test Pattern C

Each of the dot groups 31 is formed by one dot 33 in forming test pattern A and test pattern B, but the invention is not limited thereto. For example, test pattern C formed such that two dots 33 form each dot group 31 will be described.

Figure 8A:
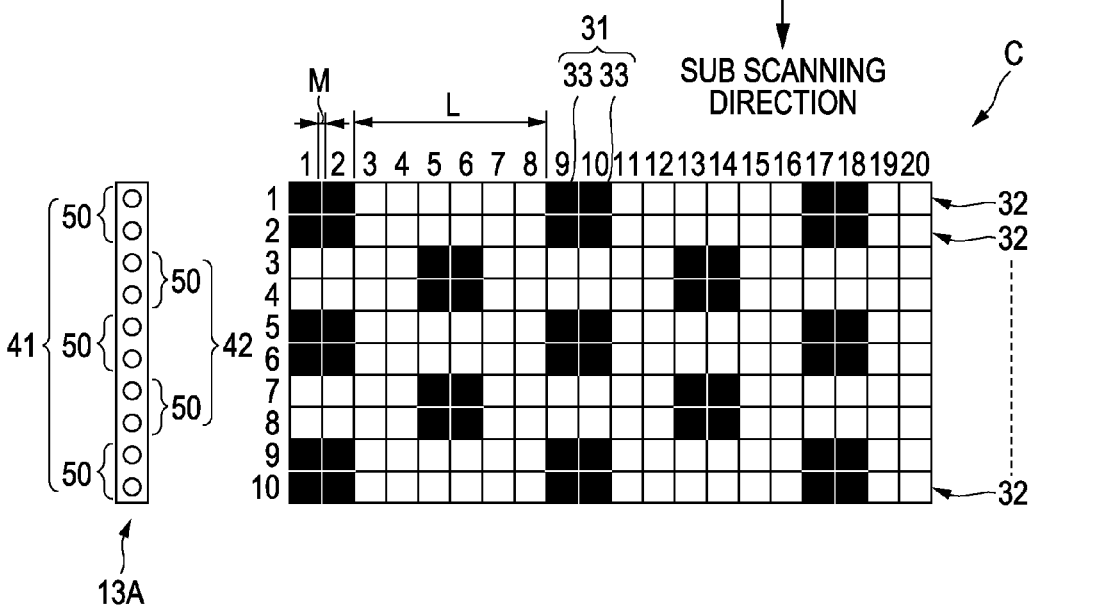
FIGS. 8A and 8B are top views illustrating examples of the test pattern according to Embodiment 1.
Figure 8B:
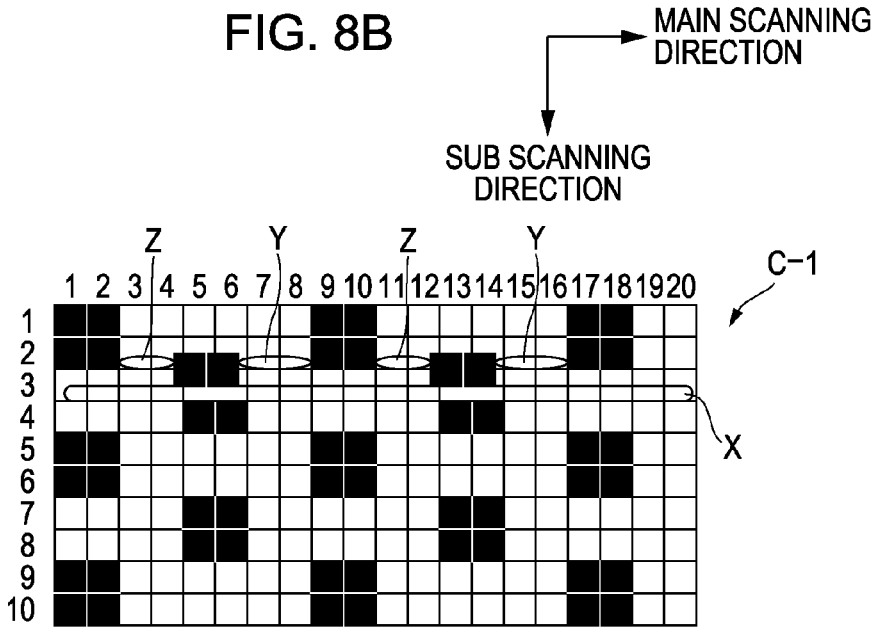

FIG. 8A is an enlarged top view illustrating an example of a test pattern according to this embodiment. FIG. 8B is an enlarged top view illustrating a test pattern when a flying curve occurs.

As shown in FIG. 8A, test pattern C is formed such that a dot group 31 where one or more dots 33 formed by the nozzle openings 13 of a nozzle group 13A line up at the reference interval M in the main scanning direction is formed, a line part 32 where a plurality of the dot groups 31 lines up at an interval L larger than the reference interval M in the main scanning direction is formed, and a plurality of the line parts 32 is formed in the sub-scanning direction. The respective dot groups 31 of the line parts 32 adjacent to each other in the sub-scanning direction line up at different positions in the main scanning direction.

In test pattern C, one dot group 31 is a group where two dots 33 line up at the reference interval M in the main scanning direction. The width of each dot group 31 in the main scanning direction is the width of two dots 33. The intervals L between the dot groups 31 forming each line part 32 are equal to each other (the width corresponding to six dots 33).

The controller 100 forms test pattern C described above under the assumption that no flying curve occurs. When the actually formed test pattern is different from test pattern C, it can be determined that a flying curve occurs.

Hereinafter, a method of controlling test pattern C will be described in detail.

The controller 100 permits a first nozzle group, where nozzle sets formed by adjacent N (where N is a natural number) nozzle openings 13 among the nozzle openings 13 forming the nozzle group 13A line up at an interval of N nozzle openings, and a second nozzle group, where the other nozzle openings 13 line up, to form the dot groups alternately in the main scanning direction.

In this embodiment, check test pattern C is formed by forming the dot groups 31 at an interval of two dots. Therefore, in a first nozzle group 41, the nozzle sets 50 formed by adjacent two nozzle openings 13 line up at the interval of two nozzle openings. In a second nozzle group 42, the other nozzle openings 13 line up.

Specifically, the controller 100 permits the first nozzle group 41 to eject the ink to the first and second columns from the left side of test pattern C. In this way, the dot groups 31 are formed in the first, second, fifth, sixth, ninth, and tenth rows of the first and second columns of test pattern C. Subsequently, the controller 100 permits the second nozzle group 42 to eject the ink in the fifth and sixth columns from the left side of test pattern C. In this way, the dot groups 31 are formed in the third, fourth, seventh, and eighth rows of the fifth and sixth columns of test pattern C.

Subsequently, the first nozzle group 41 ejects the ink in the ninth and tenth columns from the left side of test pattern C, that is, at the interval L (the width corresponding to six dots 33) from the first and second columns of dots previously formed by the first nozzle group 41. In this way, the dot groups 31 are formed in the first, second, fifth, sixth, ninth, and tenth rows of the ninth and tenth columns of test pattern C. Subsequently, the second nozzle group 42 ejects the ink in the thirteenth and fourteenth columns from the left side of test pattern C, that is, at the interval L (the width corresponding to six dots 33) from the fifth and sixth columns of dots previously formed by the second nozzle group 42. In this way, the dot groups 31 are formed in the third, fourth, seventh, and eighth rows of the thirteenth and fourteenth columns of test pattern C. Subsequently, the first nozzle group 41 ejects the ink in the seventeenth and eighteenth columns from the left side of test pattern C.

In this way, in the case where no flying curve occurs, test pattern C of the appearance shape shown in FIG. 4 is formed when the controller 100 forms test pattern C.

FIG. 8B is the top view illustrating test pattern C-1. Test pattern C-1 is formed when a flying curve occurs in the nozzle opening 13 forming a third row of dot groups 31 from the upper side. In this embodiment, as illustrated, the third row of dot groups 31 are deviated in the main scanning direction and the sub-scanning direction (an upper left side in the drawing) from the original positions, at which the ink has to be landed.

For this reason, the ground area X (the surface of the print sheet S) extending in the main scanning direction between the third and fourth rows appears. Moreover, the third row of dot groups 31 are deviated in the main scanning direction and the sub-scanning direction and the interval between the second row of dot groups 31 and the third row of dot groups 31 in the main scanning direction becomes dense. That is, since the third row of dot groups 31 are deviated in the main scanning direction, ground areas Y of which a width is relatively broader in the main scanning direction and ground areas Z of which a width is relatively narrower in the main scanning direction appear between the second row of dot groups 31 and the third row of dot groups 31.

When the flying curve occurs in the nozzle openings 13 upon forming check test pattern C where the dot groups 31 line up at the interval of six dots, test pattern C-1 containing the ground area X, the ground areas Y, and the ground areas Z may be formed. When the whole of test pattern C-1 is viewed, the ground area X, the ground areas Y, and the ground areas Z appear as a difference in shading of a horizontally extended line shape in the uniform check test pattern C-1 (see FIG. 5). Since such a difference in shading can easily be recognized, it is possible to reliably detect the flying curve occurring in the nozzle openings 13 forming the nozzle group 13A.

Test Pattern D

In forming test pattern C, each dot group 31 is formed by two dots 33 and the interval L between the dot groups 31 forming each line part 32 is the width corresponding to six dots 33, but the invention is not limited thereto. For example, test pattern D performed such that each dot group 31 is formed by four dots 33 and the interval L is the width corresponding to four dots 33 will be described.

Figure 9A:
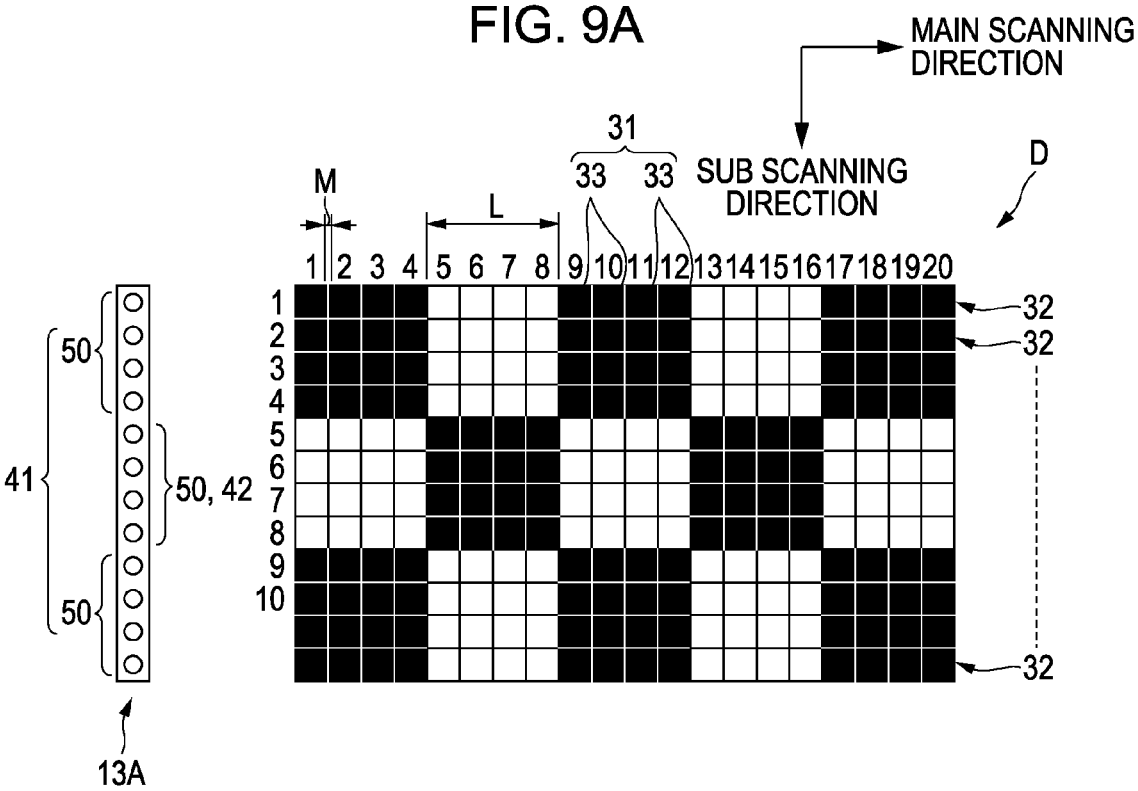
FIGS. 9A and 9B are top views illustrating examples of the test pattern according to Embodiment 1.
Figure 9B:
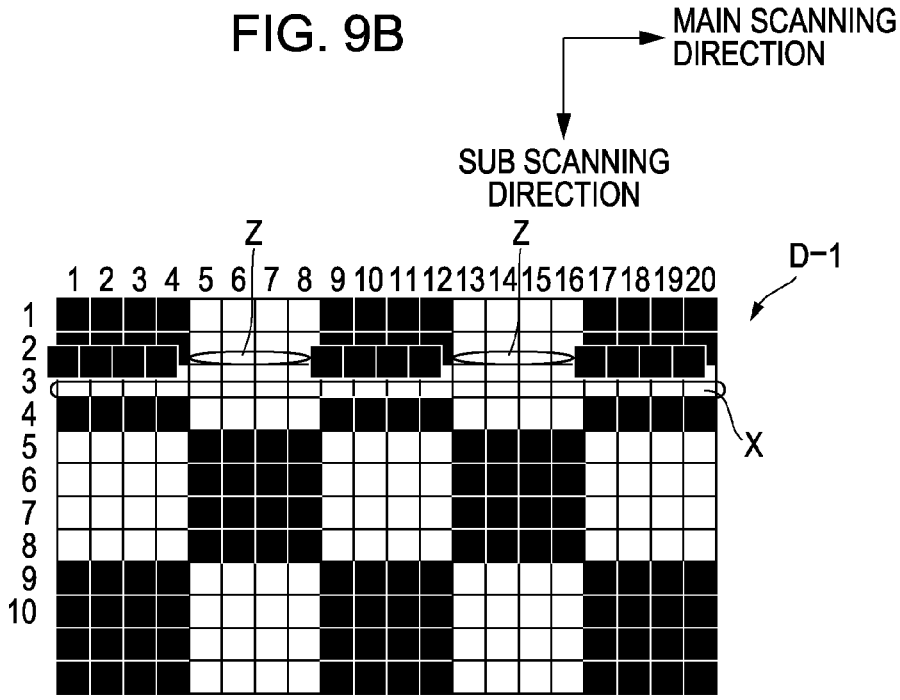

FIG. 9A is an enlarged top view illustrating an example of a test pattern according to this embodiment. FIG. 9B is an enlarged top view illustrating a test pattern when a flying curve occurs.

As shown in FIG. 9A, test pattern D is formed such that a dot group 31 where one or more dots 33 formed by the nozzle openings 13 of a nozzle group 13A line up at the reference interval M in the main scanning direction is formed, a line part 32 where a plurality of the dot groups 31 lines up at the interval L larger than the reference interval M in the main scanning direction is formed, and a plurality of the line parts 32 is formed in the sub-scanning direction. The respective dot groups 31 of the line parts 32 adjacent to each other in the sub-scanning direction line up at different positions in the main scanning direction.

In test pattern D, one dot group 31 is a group where four dots 33 line up at the reference interval M in the main scanning direction. The width of each dot group 31 in the main scanning direction is the width of four dots 33. The intervals L between the dot groups 31 forming each line part 32 are equal to each other (the width corresponding to four dots 33).

The controller 100 forms test pattern D described above under the assumption that no flying curve occurs. When the actually formed test pattern is different from test pattern D, it can be determined that a flying curve occurs.

Hereinafter, a method of controlling test pattern D will be described in detail.

The controller 100 permits a first nozzle group, where nozzle sets formed by adjacent N (where N is a natural number) nozzle openings 13 among the nozzle openings 13 forming the nozzle group 13A line up at an interval of N nozzle openings, and a second nozzle group, where the other nozzle openings 13 line up, to form the dot groups alternately in the main scanning direction.

In this embodiment, check test pattern D is formed by forming the dot groups 31 at an interval of four dots. Therefore, in this embodiment, the nozzle group 13A is formed by twelve nozzle openings 13. In a first nozzle group 41, the nozzle sets 50 formed by adjacent four nozzle openings 13 line up at an interval of four nozzle openings. In a second nozzle group 42, the other nozzle openings 13 line up.

Specifically, the controller 100 permits the first nozzle group 41 to eject the ink to first to the fourth columns from the left side of test pattern D. In this way, the dot groups 31 are formed in the first, second, third, and fourth rows of the first to fourth columns of test pattern D. Subsequently, the controller 100 permits the second nozzle group 42 to eject the ink in the fifth to eighth columns from the left side of test pattern D. In this way, the dot groups 31 are formed in the fifth, sixth, seventh, and eighth rows of the fifth to eighth columns of test pattern D.

Subsequently, the first nozzle group 41 ejects the ink in the ninth and twelfth columns from the left side of test pattern D, that is, at the interval L (the width corresponding to four dots 33) from the first to fourth columns of dots previously formed by the first nozzle group 41. In this way, the dot groups 31 are formed in the first, second, third, and fourth rows of the ninth to twelfth columns of test pattern D. Subsequently, the second nozzle group 42 ejects the ink in the thirteenth to sixteenth columns from the left side of test pattern D, that is, at the interval L (the width corresponding to four dots 33) from the fifth to eighth columns of dots previously formed by the second nozzle group 42. In this way, the dot groups 31 are formed in the fifth, sixth, seventh, and eighth rows of the thirteenth to sixteenth columns of test pattern D. Subsequently, the first nozzle group 41 ejects the ink in the seventeenth and twentieth columns from the left side of test pattern D.

In this way, in the case where no flying curve occurs, test pattern D of the appearance shape shown in FIG. 4 is formed when the controller 100 forms test pattern D.

FIG. 9B is the top view illustrating test pattern D-1. Test pattern D-1 is formed when a flying curve occurs in the nozzle opening 13 forming a third row of dot groups 31 from the upper side. In this embodiment, as illustrated, the third row of dot groups 31 is deviated in the main scanning direction and the sub-scanning direction (an upper left side in the drawing) from the original positions, at which the ink has to be landed.

For this reason, the ground area X (the surface of the print sheet S) extending in the main scanning direction between the third and fourth rows appears. Moreover, ground areas Y appear in the main scanning direction between the second row of dot groups 31 and the third row of dot groups 31 to the degree that the third row of dot groups 31 overlaps with the second row of dot groups 31. That is, since the ground areas Y appear in the left ends of the third row of dot groups 31 deviated from the right end to the left upper side of the second dot groups 31, the width of the ground area Y in the main scanning direction is narrower than the width of the interval L.

When the flying curve occurs in the nozzle openings 13 upon forming check test pattern D where the dot groups 31 line up at the interval of four dots, test pattern D-1 containing the ground area X and the ground areas Y may be formed. When the whole of test pattern D-1 is viewed, the ground area X and the ground areas Y appear as a difference in shading of a horizontally extended line shape in the uniform check test pattern D-1 (see FIG. 5). Since such a difference in shading can easily be recognized, it is possible to reliably detect the flying curve occurring in the nozzle openings 13 forming the nozzle group 13A.

Test Pattern E

Figure 10A:
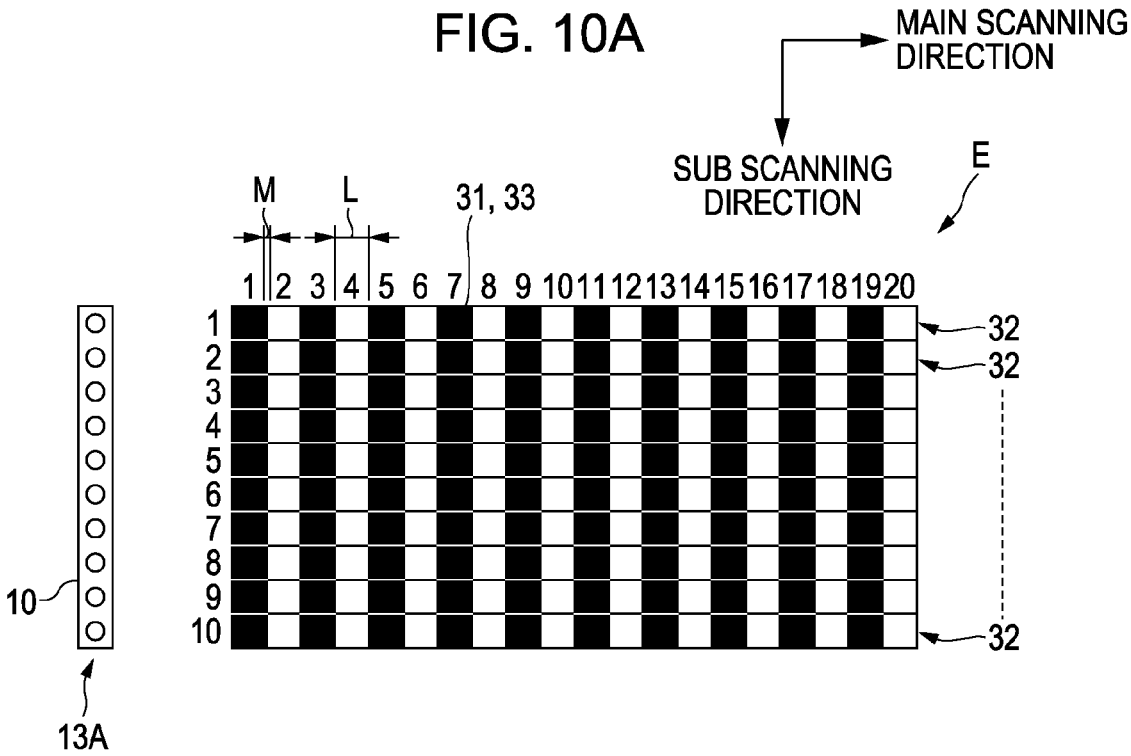
FIGS. 10A and 10B are top views illustrating examples of the test pattern according to Embodiment 1.
Figure 10B:
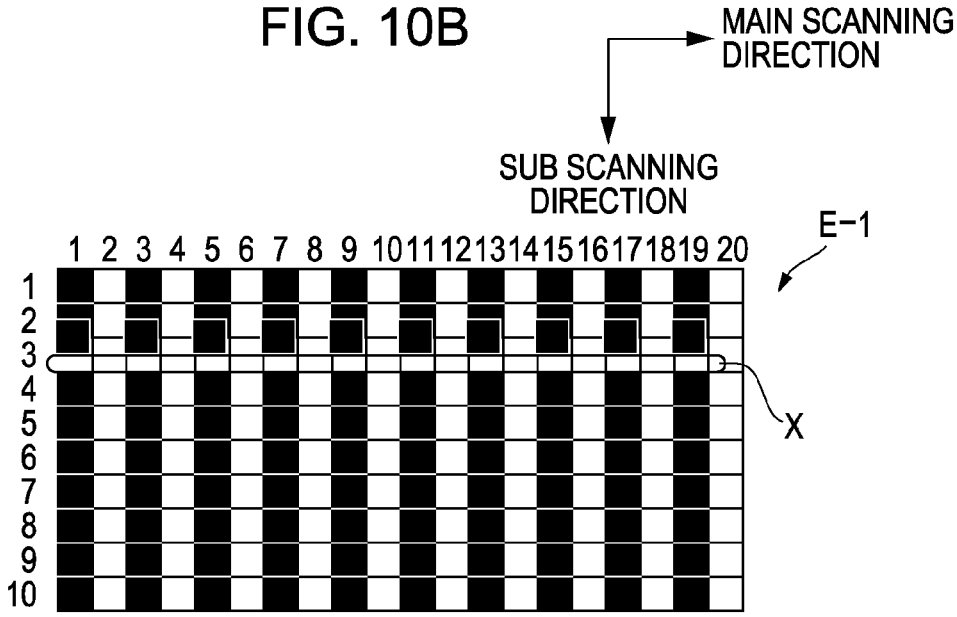

FIG. 10A is an enlarged top view illustrating an example of a test pattern according to this embodiment. FIG. 10B is an enlarged top view illustrating a test pattern when a flying curve occurs.

As shown in FIG. 10A, test pattern E is formed such that a dot group 31 where one or more dots 33 formed by the nozzle openings 13 of a nozzle group 13A line up at a reference interval M in the main scanning direction is formed, a line part 32 where a plurality of the dot groups 31 lines up at an interval L larger than the reference interval M in the main scanning direction is formed, and a plurality of the line parts 32 is formed in the sub-scanning direction. The respective dot groups 31 of the line parts 32 adjacent to each other in the sub-scanning direction line up at different positions in the main scanning direction.

The dot group 31 refers to a group where one or more dots 33 formed by the nozzle openings 13 of the nozzle group 13A line up at the reference interval M in the main scanning direction. Here, "the group where one or more dots 33 line up at the reference interval M in the main scanning direction" includes one dot group 31 formed by one dot 33. In test pattern E, one dot group 31 is formed by one dot 33.

The width of each dot group 31 in the main scanning direction is the width of one dot 33. The intervals L between the dot groups 31 forming each line part 32 are equal to each other (the width corresponding to one dot 33).

The controller 100 forms test pattern E described above under the assumption that no flying curve occurs. When the actually formed test pattern is different from test pattern E, it can be determined that a flying curve occurs.

Hereinafter, a method of controlling test pattern E will be described in detail.

The controller 100 permits all of the nozzle openings 13 of the nozzle group 13A to form the plurality of dot groups 31 at the interval L in the main scanning direction.

Specifically, the controller 100 permits the nozzle group 13A to eject the ink to a first column from the left side of test pattern E. In this way, the dot groups 31 are formed in the first to tenth rows of the first column of test pattern E. Subsequently, the controller 100 permits the nozzle group 13A to eject the ink in a third column from the left side of test pattern E at the interval L. In this way, the dot groups 31 are formed in the first to tenth rows of the third column of test pattern E. Subsequently, the dot groups 31 are repeatedly formed up to a twentieth column from the left side of test pattern E.

In this way, in the case where no flying curve occurs, test pattern E of the appearance shape shown in FIG. 4 is formed when the controller 100 forms test pattern E.

FIG. 10B is the top view illustrating test pattern E-1. Test pattern E-1 is formed when a flying curve occurs in the nozzle opening 13 forming the third row of dot groups 31 from the upper side. In this embodiment, as illustrated, the third row of dot groups 31 is deviated in the sub-scanning direction (an upper left side in the drawing) from the original positions, at which the ink has to be landed, and thus overlaps with a second row of dot groups 31.

For this reason, a ground area X (the surface of the print sheet S) extending in the main scanning direction between the third and fourth rows appears.

When the flying curve occurs in the nozzle openings 13 upon forming test pattern E where the dot groups 31 line up vertically (line up in the sub-scanning direction), test pattern E-1 containing the ground area X may be formed. When the whole of test pattern E-1 is viewed, the ground area X appears as a difference in shading of a horizontally extended line shape in the uniform check test pattern E-1 (see FIG. 5). Since such a difference in shading can easily be recognized, it is possible to reliably detect the flying curve occurring in the nozzle openings 13 forming the nozzle group 13A.

Test Pattern F

Figure 11A:
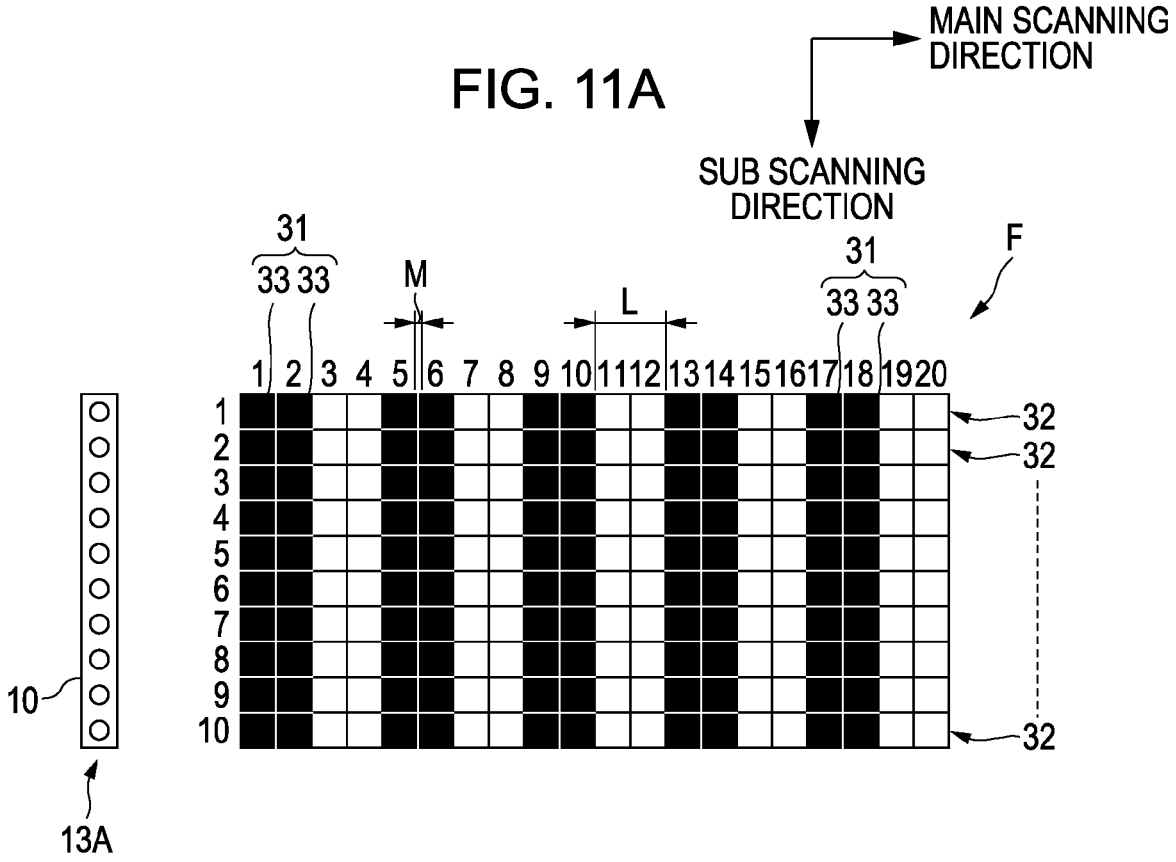
FIGS. 11A and 11B are top views illustrating examples of the test pattern according to Embodiment 1.
Figure 11B:
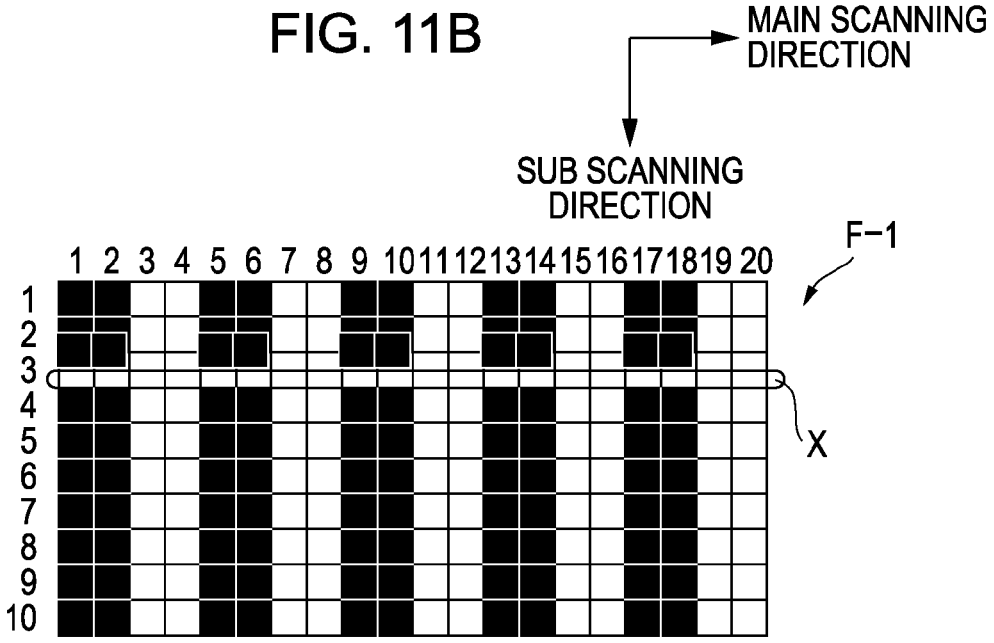

FIG. 11A is an enlarged top view illustrating an example of a test pattern according to this embodiment. FIG. 11B is an enlarged top view illustrating a test pattern when a flying curve occurs.

As shown in FIG. 11A, test pattern F is formed such that a dot group 31 where one or more dots 33 formed by the nozzle openings 13 of a nozzle group 13A line up at a reference interval M in the main scanning direction is formed, a line part 32 where a plurality of the dot groups 31 lines up at an interval L larger than the reference interval M in the main scanning direction is formed, and a plurality of the line parts 32 is formed in the sub-scanning direction. The respective dot groups 31 of the line parts 32 adjacent to each other in the sub-scanning direction line up at the same positions in the main scanning direction.

Each dot group 31 is formed by two dots 33. The width of each dot group 31 in the main scanning direction is the width of two dots 33. The intervals L between the dot groups 31 forming each line part 32 are equal to each other (the width corresponding to two dots 33).

The controller 100 forms test pattern F described above under the assumption that no flying curve occurs. When the actually formed test pattern is different from test pattern F, it can be determined that a flying curve occurs.

Hereinafter, a method of controlling test pattern F will be described in detail.

The controller 100 permits all of the nozzle openings 13 of the nozzle group 13A to form the plurality of dot groups 31 at the interval L in the main scanning direction.

Specifically, the controller 100 permits the nozzle group 13A to eject the ink to the first and second columns from the left side of test pattern F. In this way, the dot groups 31 are formed in the first to tenth rows of the first and second columns of test pattern F. Subsequently, the controller 100 permits the nozzle group 13A to eject the ink in the fifth and sixth columns from the left side of test pattern F at the interval L. In this way, the dot groups 31 are formed in the first to tenth rows of the fifth and sixth columns of test pattern F. Subsequently, the dot groups 31 are repeatedly formed up to a twentieth column from the left side of test pattern F.

In this way, in the case where no flying curve occurs, test pattern F of the appearance shape shown in FIG. 4 is formed when the controller 100 forms test pattern F.

FIG. 11B is the top view illustrating test pattern F-1. Test pattern F-1 is formed when a flying curve occurs in the nozzle opening 13 forming the third row of dot groups 31 from the upper side. In this embodiment, as illustrated, the third row of dot groups 31 is deviated in the sub-scanning direction (an upper side in the drawing) from the original positions, at which the ink has to be landed, and thus overlaps with a second row of dot groups 31.

For this reason, a ground area X (the surface of the print sheet S) extending in the main scanning direction between the third and fourth rows appears.

When the flying curve occurs in the nozzle openings 13 upon forming test pattern F where the dot groups 31 line up vertically (line up in the sub-scanning direction), test pattern F-1 containing the ground area X may be formed. When the whole of test pattern F-1 is viewed, the ground area X appears as a difference in shading of a horizontally extended line shape in the uniform test pattern F-1 (see FIG. 5). Since such a difference in shading can easily be recognized, it is possible to reliably detect the flying curve occurring in the nozzle openings 13 forming the nozzle group 13A.

As described above, the ink jet printing apparatus according to the invention ejects the ink on the print sheet S to form the uniform test pattern with a check shape or a vertical line shape. When the flying curve occurs in the printing head 10, the difference in shading occurs in the uniform test pattern. Since such a difference in shading can easily be recognized, it is possible to detect the flying curve occurring in the printing head 10 by use of the difference in the shading.

Embodiment 2

In Embodiment 1 described above, the nozzle group of one nozzle row arranged in the nozzle plate 14 of the printing head 10 is configured, but the invention is not limited thereto. For example, in the case of the printing head 10 having a plurality of nozzle rows, all of the nozzle openings 13 forming the plurality of nozzle rows may be set as the nozzle group 13A.

For example, test pattern C formed by the printing head 10 in which two nozzle rows formed by five nozzle openings 13 are arranged will be described.

Figure 12:
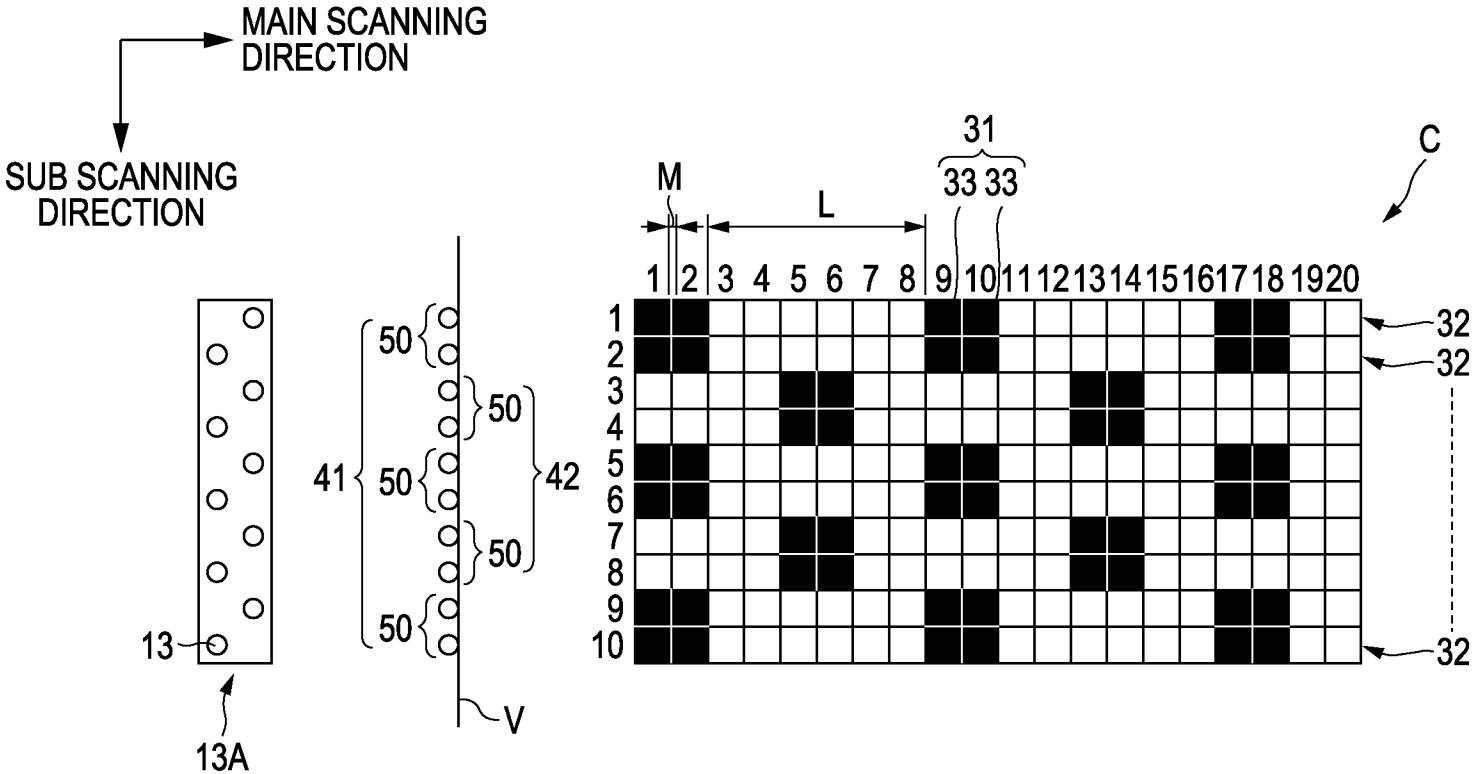
FIG. 12 is a top view illustrating an example of a test pattern according to Embodiment 2.

FIG. 12 is an enlarged top view illustrating an example of the test pattern according to Embodiment 2. As illustrated, two nozzle rows in which the five nozzle openings 13 line up are formed in the printing head 10. The two nozzle rows are arranged in zigzags so that the nozzle openings 13 forming one nozzle row are located between the nozzle openings 13 forming the other nozzle row. The reason for forming the nozzle rows in this way is that the distance between the nozzle openings 13 is made more densely to perform printing high density.

In this embodiment, all of the nozzle openings 13 forming the two nozzle rows are set as the nozzle group 13A. Even in the case of the nozzle group 13A formed by the plurality of nozzle rows, test pattern C can be formed in the following way.

First, the controller 100 permits a first nozzle group, where nozzle sets formed by adjacent N (where N is a natural number) nozzle openings 13 among the nozzle openings 13 forming the nozzle group 13A line up at an interval of N nozzle openings, and a second nozzle group, where the other nozzle openings 13 line up, to form the dot groups alternately in the main scanning direction.

Here, "the nozzle sets formed by adjacent N nozzle openings" in the nozzle group 13A formed by the plurality of nozzle rows refer to N nozzle openings adjacent to each other at imaginary positions of the nozzle openings projected on an imaginary straight line V made by extending all of the nozzle openings 13 in the sub-scanning direction.

In this embodiment, check test pattern C is formed by forming the dot groups 31 at the interval of two dots. Therefore, in the first nozzle group 41, the nozzle sets 50 formed by adjacent two nozzle openings 13 line up at the interval of two nozzle openings. In a second nozzle group 42, the other nozzle openings 13 line up.

More particularly, one nozzle set 50 is formed by adjacent two nozzle openings 13 at the imaginary positions of the nozzle openings projected on the straight line V. A group where the nozzle sets 50 line up at an interval of two nozzle openings is set as the first nozzle group 41. A group where the other nozzle sets 50 line up is set as the second nozzle group 42.

Subsequently, the controller 100 permits the first nozzle group 41 to eject the ink to the first and second columns from the left side of test pattern C. In this way, the dot groups 31 are formed in the first, second, fifth, sixth, ninth, and tenth rows of the first and second columns of test pattern C. Subsequently, the controller 100 permits the second nozzle group 42 to eject the ink in the fifth and sixth columns from the left side of test pattern C. In this way, the dot groups 31 are formed in the third, fourth, seventh, and eighth rows of the fifth and sixth columns of test pattern C.

Subsequently, the first nozzle group 41 ejects the ink in the ninth and tenth columns from the left side of test pattern C, that is, at the interval L (the width corresponding to six dots 33) from the first and second columns of dots previously formed by the first nozzle group 41. In this way, the dot groups 31 are formed in the first, second, fifth, sixth, ninth, and tenth rows of the ninth and tenth columns of test pattern C. Subsequently, the second nozzle group 42 ejects the ink in the thirteenth and fourteenth columns from the left side of test pattern C, that is, at the interval L (the width corresponding to six dots 33) from the fifth and sixth columns of dots previously formed by the second nozzle group 42. In this way, the dot groups 31 are formed in the third, fourth, seventh, and eighth rows of the thirteenth and fourteenth columns of test pattern C. Subsequently, the first nozzle group 41 ejects the ink in the seventeenth and eighteenth columns from the left side of test pattern C.

In this way, in the case where no flying curve occurs, test pattern C of the appearance shape shown in FIG. 4 is formed when the controller 100 forms test pattern C.

As in test pattern C described above, it is not necessary to form test pattern C by ejecting the ink while the printing head 10 moves from one end (the left side in FIG. 12) to the other end (the right side in FIG. 12) in the main scanning direction.

For example, test pattern C may be formed in such a manner that the first, third, fifth, seventh, and ninth rows of line parts 32 are formed by forming some of test pattern C by one nozzle row forming the nozzle group 13A when the printing head 10 moves from one end (the left side in FIG. 12) to the other end (the right side in FIG. 12) in the main scanning direction to simultaneously eject the ink, and then the second, fourth, sixth, eighth, and tenth rows of line parts 32 are formed by forming the remainder of test pattern C by the other nozzle row forming the nozzle group 13A when the printing head 10 moves from the other end to one end in the main scanning direction to simultaneously eject the ink.

Other Embodiments

The embodiments of the invention have been described, but the basic configuration of the invention is not limited to the above-described configuration.

In Embodiment 1 and Embodiment 2 described above, one nozzle row forms one nozzle group, but the invention is not limited thereto. Some of the nozzle openings forming one nozzle row may be set as a nozzle group. In this way, the test pattern may be formed using the specific nozzle openings. When the ink jet printing head 10 includes a plurality of printing heads 10, one nozzle group formed by the nozzle openings of all the printing heads may be set. With such a configuration, since one test pattern is formed by the plurality of printing heads, it is possible to detect whether the flying curve of all the printing heads occurs. Moreover, a plurality of nozzle groups may be formed by the nozzle openings of each printing head to form the test pattern for each nozzle group. With such a configuration, it is possible to detect whether the flying curve of each printing head occurs.

In Embodiment 1 described above, the test pattern is formed by scanning the printing head 10 on the print sheet S in the main scanning direction once. But the scanning may be performed several times.

In Embodiment 1 and Embodiment 2 described above, the test pattern data used to form the test pattern is stored in the storage device 104 of the ink jet printing apparatus, but the invention is not limited thereto. For example, the liquid ejecting apparatus according to the invention may obtain the test pattern data from an information processing apparatus such as a PC via a predetermined interface.

In the above-described embodiments, the ink jet printing head 10 ejecting ink droplets is used as an example to describe the invention, but the invention is applicable to all kinds of liquid ejecting heads. Examples of the liquid ejecting head include a printing head used in an image printing apparatus such as a printer, a color material ejecting head used to manufacture a color filter such as a liquid crystal display, an electrode material ejecting head used to form an electrode such as an organic EL display or an FED (Field Emission Display), and a bio organism ejecting head used to manufacture a bio chip.

What is claimed is:

1. A liquid ejecting apparatus comprising:

a liquid ejecting head having a nozzle row in which a plurality of nozzles ejecting a liquid on an ejecting target medium is arranged;

a moving unit which relatively moves the liquid ejecting head with respect to the ejecting target medium in a main scanning direction intersecting an arrangement direction of the nozzles; and a control unit which permits the liquid ejecting head to eject the liquid so as to form a plurality of test patterns on the ejecting target medium, a nozzle row having a first nozzle group wherein nozzle sets formed by adjacent N (where N is a natural number) nozzles in the nozzle group line up at an interval of N nozzles, and a second nozzle group, where the other nozzles sets of the second nozzle group line up, the test pattern being formed such that a first dot group and a second dot group line up at an interval larger than a reference interval M in a main scanning direction, wherein the first dot group having a plurality of dots where dots are formed from the nozzles of the first nozzle group, the second dot group having a plurality of dots where dots are formed from the nozzles of the second nozzle group, and the plurality of dots lining up at the reference interval M in the main scanning direction.

2. A method of detecting a flying curve of dots formed by a liquid ejecting apparatus including a liquid ejecting head and a moving unit, the liquid ejecting head having a nozzle row which has a first nozzle group wherein nozzle sets formed by adjacent N (where N is a natural number) nozzles in the nozzle group line up at an interval of N nozzles, and a second nozzle group wherein the other nozzles sets of the second nozzle group line up in the interval, the moving unit moving the liquid ejecting head with respect to the target medium in a main scanning direction intersecting an arrangement direction of the nozzles, the method comprising:

the $1^{st}$ step of ejecting the liquid from the first nozzle group, the $2^{nd}$ step of moving the liquid ejecting head by a reference interval M, the $3^{rd}$ step of ejecting the liquid from the first nozzle group, the $4^{th}$ step of ejecting the liquid from the second nozzle group, the $5^{th}$ step of moving the liquid ejecting head by the reference interval M, and the $6^{th}$ step of ejecting the liquid from the second nozzle group;

wherein the steps of ejecting the liquid from the first nozzle group and the second nozzle group form a test pattern such that a first dot group and a second dot group line up at an interval larger than the reference interval M in a main scanning direction, and wherein the first dot group having a plurality of dots where dots are formed from the nozzles of the first nozzle group, the second dot group having a plurality of dots where dots are formed from the nozzles of the second nozzle group, and the plurality of dots lining up at the reference interval M in the main scanning direction.

* * * * *